US006421511B2

(12) United States Patent
Sugiyama et al.

(10) Patent No.: US 6,421,511 B2
(45) Date of Patent: Jul. 16, 2002

(54) TRANSFER DEVICE AND IMAGE FORMATION APPARATUS

(75) Inventors: Toshihiro Sugiyama; Hiroshi Ishii; Hiroshi Saitoh; Atsuko Miyashita, all of Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/726,530

(22) Filed: Dec. 1, 2000

(30) Foreign Application Priority Data

Dec. 3, 1999 (JP) ..... 11-345064
Dec. 3, 1999 (JP) ..... 11-345069
Mar. 8, 2000 (JP) ..... 2000-063915

(51) Int. Cl.[7] ..... G03G 15/16; G03G 21/00
(52) U.S. Cl. ..... 399/101; 399/297; 399/357
(58) Field of Search ..... 399/101, 297, 399/314, 343, 357, 71; 492/27, 49, 53, 56; 29/895, 895.212

(56) References Cited

U.S. PATENT DOCUMENTS 5,148,227 A * 9/1992 Senba et al. ..... 399/357 X
5,559,593 A * 9/1996 Yoshinaga et al. ..... 399/343
5,678,140 A * 10/1997 Fuei et al. ..... 399/109
5,790,927 A * 8/1998 Ando et al. ..... 399/176
5,809,373 A * 9/1998 Yoda et al. ..... 399/101
5,909,611 A * 6/1999 Iwakura ..... 399/297 X
6,097,924 A * 8/2000 Okuyama ..... 399/101 X

FOREIGN PATENT DOCUMENTS

| | | |
|---|---|---|
| JP | 7-064444 | 3/1995 |
| JP | 8-305121 | 11/1996 |
| JP | 9-152788 | 6/1997 |
| JP | 11-310773 | 10/1999 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A transfer device for transferring a toner image formed on an image carrier onto a transfer material conveyed on a transfer belt. The transfer device includes a cleaning member having a dielectric surface layer for cleaning a surface of the transfer belt, and a bias application unit for applying to the cleaning member a cleaning bias having an opposite polarity to an electric charge polarity of a toner forming the toner image. Further, specific characteristic values of the dielectric surface layer are set to achieve a higher than predetermined cleaning level, such as setting a volume resistivity of the dielectric surface layer is set to 1E4 ohms/square or more.

20 Claims, 5 Drawing Sheets

TRANSFER DEVICE AND IMAGE FORMATION APPARATUS

FIELD OF THE INVENTION

The present invention relates to a transfer device and an image formation apparatus such as a copier, a facsimile, or a printer each equipped with the transfer device. More particularly, this invention relates to the transfer device which has a transfer belt supported by a plurality of rotors and carries and conveys a transfer material, and a cleaning member that cleans the surface of the transfer belt, and which transfers a toner image formed on the image carrier onto a transfer material on the transfer belt. This transfer device also has a dielectric layer on the surface of the cleaning member. This invention also relates to the image formation apparatus with the transfer device.

BACKGROUND OF THE INVENTION

Conventionally, a transfer device for transferring a toner image formed on an image carrier onto a transfer material has been provided in an image formation apparatus such as a copier or a printer.

As this type of transfer device, there has been known one that carries transfer paper as a transfer material on the transfer belt and conveys it to a transfer area where a photosensitive body as an image carrier and a transfer belt supported by a support roller as a rotor are provided opposite to each other and contact each other. This transfer device then generates a transfer electric field at the transfer area when the transfer paper passes through the transfer area, and transfers the toner image formed on the photosensitive body onto the transfer paper by this transfer electric field.

In the transfer device configured as explained above, because the transfer belt and the photosensitive body contact each other via transfer paper, toner dirt stuck on the photosensitive body or splashed toner at the time of transfer maybe deposited on the transfer belt, which causes inconvenience such as soil on the back of the transfer paper or defective transfer. Therefore, it is necessary to additionally provide a cleaning unit to remove the toner deposited on the transfer belt in the transfer device.

As a cleaning unit for a transfer belt, there has been conventionally known a cleaning unit in an electric-field cleaning method in which the toner on the transfer belt is electrostatically moved to the side if a cleaning member by rubbing the surface of the transfer belt with a conductive member as a cleaning member to which a cleaning bias of the opposite polarity to an electric charge polarity of the toner is applied (e.g., JP, HEI 07-64444 A, JP, HEI 09-152788 A). In this electric-field cleaning method, an electric field which has electrostatic force (hereafter referred to as bias electric field) to allow the toner on the transfer belt to move toward the conductive member is produced between the conductive member and the transfer belt. The toner on the transfer belt is moved to the cleaning member side by this bias electric field to clean the toner off the transfer belt.

In the electric-field cleaning method, however, sufficient cleaning performance could not be obtained, and imperfect cleaning sometimes occurred. This imperfect cleaning easily occurs especially when a transfer belt with high resistance such that volume resistivity is $10^{12}$ to $10^{13}$ ohm-cm or more is used or when the amount of charge on toner is large.

When the high-resistance transfer belt is used, force with which toner is electrostatically absorbed to the transfer belt is increased because dielectric polarization is easily generated as compared to a belt with low resistance, and transfer charge applied to the belt at the time of transfer, that is, electric charge of the opposite polarity to an electric charge polarity of toner is easily held on the charge-applied surface. When the amount of charge on the toner is large, the force with which the toner is electrostatically absorbed to the transfer belt is also increased based on Coulomb force or image force. The toner on the transfer belt is layered, therefore, when electrostatic absorption force between the toner and the transfer belt is such strong, there is sometimes a case where even the toner on the top layer can not be moved to the conductive member side by the cleaning electric field. Therefore, it is conceivable that, when the electrostatic absorption force between the toner and the transfer belt is strong, a cleaning bias to be applied to the conductive member is increased in order to obtain excellent cleaning performance according to the electric-field cleaning method.

However, when the cleaning bias is too large, dielectric breakdown may be produced at a contact section between the cleaning member and the transfer belt in the thickness direction of the transfer belt, which may cause a current to leak. When the current leaks, the bias electric field is not formed, thus, sufficient cleaning performance in the electric-field cleaning method can not be attained.

Further, when the cleaning bias is too large, electric charge of the opposite polarity to that of toner is injected to the toner on the transfer belt, so that the electric charge polarity of the toner may be reversed. Such toner whose electric charge polarity has been reversed (hereafter referred to as reversed-polarity toner) can not be cleaned off in the electric-field cleaning method. Therefore, the reversed-polarity toner becomes a cause of reduction in cleaning performance.

Not only is there a case where the reversed-polarity toner is generated by injection of charge, but also there is a case where the reversed-polarity toner may be deposited on the transfer belt when the reversed-polarity toner existing on the surface of the photosensitive body contacts the transfer belt. Such reversed-polarity toner then becomes a cause of reduction in cleaning performance as well.

The applicant of this invention has proposed (Patent Application No. HEI 11-301773) a transfer device which can clean the surface of a transfer belt more sufficiently than the conventional electric-field cleaning method and also can clean reversed-polarity toner off the belt even when a high-resistance transfer belt is used or when the amount of charge on toner is large, and also has proposed an image formation apparatus with the transfer device. In this transfer device, when the dielectric layer provided on the surface of the cleaning member and the toner on the transfer belt contact each other, electric charge of the opposite polarity to an electric charge polarity of the toner is induced on the surface of the dielectric layer by dielectric polarization, and electrostatic absorption force is generated between the dielectric layer and the toner. Accordingly, electrostatic absorption force between the toner and the dielectric layer (hereafter referred to as dielectric absorption force) and electrostatic absorption force between the transfer belt and the toner (hereafter referred to as belt absorption force) act on the layered toner between the transfer belt and the dielectric layer. Each magnitude of the respective electrostatic absorption force acting on the toner varies inversely with the square of the distance to the toner. Therefore, the dielectric absorption force is stronger than the belt absorption force with respect to the toner on the top layer of the surface of the transfer belt, which allows the toner to be moved to the side of the dielectric layer and the toner to be cleaned off the transfer belt. Accordingly, even when a high-resistance transfer belt is used or when the amount of charge on toner is large, the surface of the transfer belt can be more sufficiently cleaned as compared to that of the conventional electric-field cleaning method. Further, electric charge of the opposite polarity to an electric charge polarity of toner is always induced on the surface of the dielectric layer, therefore, the toner whose electric charge polarity has been reversed can also be moved to the surface of the dielectric layer. Resultantly, soil on the back of a transfer material due to imperfect cleaning of a transfer belt or defective transfer do not possibly occur.

It has also been proposed in the specification according to the earlier filed application that a bias application unit, that applies a cleaning bias of the opposite polarity to the electric charge polarity of the toner to the cleaning member, is provided and also a bias electric field which allows the toner to move toward the cleaning member is produced between the cleaning member and the transfer belt. According to the specification, a cleaning effect of an electric field is added to a cleaning effect of a dielectric layer, which allows more excellent cleaning performance to be attained.

SUMMARY OF THE INVENTION

A first object of this invention is to provide a transfer device, which can maintain a cleaning effect of a dielectric layer higher than a predetermined level and effectively clean a transfer belt by specifying characteristic values of the dielectric layer provided on the surface of a cleaning member, and an image formation apparatus with the transfer device.

A second object of this invention is to provide a transfer device, which can maintain a cleaning effect of a dielectric layer higher than a predetermined level and effectively clean a transfer belt by specifying a value of electrostatic capacitance of the dielectric layer provided on the surface of a cleaning member, and an image formation apparatus with the transfer device.

A third object of this invention is to provide a transfer device, which can maintain a cleaning effect of a dielectric layer on a transfer conveyor belt higher than a predetermined level and effectively clean the transfer conveyor belt by defining a material of the dielectric layer provided on the surface of a cleaning member, and an image formation apparatus with the transfer device.

In the earlier application, there has been disclosed the example of a configuration when a cleaning roller is used as the cleaning member and the outer periphery of the roller is coated with a tube made with a nylon-base material as the dielectric layer. When the cleaning roller is thus coated with the tube, the tube may not follow rotation of the roller and slip if adhesion between the two is not sufficient. When the slip caused by such insufficient adhesion occurs, imperfect cleaning of a transfer conveyor belt occurs.

In order to keep adhesion between the tube and the roller, it is also conceivable to bond the two with an adhesive. However, application of the adhesive makes these two awkward to be handled at the time of manufacturing. Further, depending on the adhesives, electric nonuniformity occurs on the cleaning roller. These disadvantages should be avoided.

A fourth object of this invention is to provide a transfer device which can prevent imperfect cleaning of a transfer conveyor belt due to insufficient adhesion by promoting adhesion between a roller-shaped member and a dielectric layer without using an adhesive when the dielectric layer is provided on the roller-shaped member as a cleaning member, and an image formation apparatus with the transfer device.

According to one aspect of this invention, in a transfer device, a part of toner on a transfer belt moves to the surface of a dielectric layer by dielectric polarization generated on the surface of the dielectric layer due to a contact between the dielectric layer and the toner. While some other part of the toner moves to the surface of the dielectric layer by a bias electric field formed by a bias application unit. At this time, if volume resistivity of the dielectric layer is too small, the dielectric layer exhibits conductivity. Therefore, the dielectric polarization due to a contact of the layer to the toner hardly occurs, a cleaning effect of the dielectric layer is reduced, thus, only a cleaning effect of the electric field may be obtained. Further, if a cleaning bias to be applied to a cleaning member is increased in order to enhance the cleaning effect of the electric field when the volume resistivity of the dielectric layer is too small, dielectric breakdown may occur in the thickness direction of the dielectric layer.

Therefore, in this transfer device, by setting volume resistivity of the dielectric layer to 1E3 ohm-cm or more, the conductivity of the dielectric layer is not made too high, so that the cleaning effect of the dielectric layer is maintained higher than a predetermined level. Further, the dielectric breakdown of the dielectric layer due to the cleaning bias is prevented.

Further, if the volume resistivity of the dielectric layer is too large, insulating strength of the dielectric layer becomes too high. Accordingly, a bias electric field produced between the cleaning member and the transfer belt becomes insufficient, which may cause the cleaning effect of the electric field to be reduced.

Therefore, in this transfer device, the volume resistivity of the dielectric layer is set to 1E15 ohm-cm or less, so that the bias electric field can be ensured sufficiently and the cleaning effect of the electric field can also be maintained higher than a predetermined level.

Further, in this transfer device, a cleaning bias to be applied to the cleaning member is set to 300 volts or more, so that the cleaning effect of the electric field is sufficiently ensured. The cleaning bias is also set to 2500 volts or less, so that the cost of power to be used will not increase.

According to another aspect of this invention, surface resistivity of the dielectric layer is set to 1E4 ohms/square or more, so that the conductivity of the dielectric layer is not made too high, and the cleaning effect of the dielectric layer is maintained higher than a predetermined level.

According to still another aspect of this invention, in a transfer device, if a dielectric constant of the dielectric layer is too small, electrostatic capacitance becomes too small, so that the amount of charge, that is, the amount of toner which can be deposited on the surface of the dielectric layer is decreased, and the cleaning effect of the dielectric layer may be reduced.

Therefore, in this transfer device, the dielectric constant of the dielectric layer is set to 3 or more, so that the sufficient electrostatic capacitance is stored, and the cleaning effect of the dielectric layer is maintained higher than a predetermined level.

Further, in this transfer device, the cleaning effect of the dielectric layer is maintained higher than a predetermined level and further the cleaning effect of the electric field can be obtained. Thus, the surface of the transfer belt can be cleaned more sufficiently.

According to still another aspect of this invention, in an image formation apparatus, the transfer device is used as a transfer device, so that toner dirt stuck on an image carrier which is deposited on the transfer belt or splashed toner at the time of transfer can sufficiently be cleaned off in a state where the cleaning effect of the dielectric layer is maintained higher than a predetermined level. Thus, soil on the back of a transfer material due to imperfect cleaning of the belt, or defective transfer can be prevented from its occurrence.

According to still another aspect of this invention, in a transfer device, toner on a transfer belt moves to the surface of a dielectric layer by dielectric polarization generated on the surface of the dielectric layer due to a contact between the dielectric layer and the toner. At this time, if the electrostatic capacitance of the dielectric layer is too small, the amount of charge, that is, the amount of toner which can be deposited on the surface of the dielectric layer is decreased. Thus, the cleaning effect of the dielectric layer may be reduced.

Therefore, in this transfer device, the electrostatic capacitance of the dielectric layer is set to 100 pF or more, so that the amount of charge enabling deposition on the surface of the dielectric layer is sufficiently stored, and the cleaning effect of the dielectric layer is maintained higher than a predetermined level.

The value of electrostatic capacitance is determined by a dielectric constant and a thickness of the dielectric layer. Therefore, there is a conceivable method here for controlling the dielectric constant by dispersing, for example, a resistance control agent into the dielectric layer to manage the electrostatic capacitance. However, the volume resistivity and the surface resistivity of the dielectric layer vary in response to variation of the dielectric constant, which is not preferable. Therefore, it is desirable that the electrostatic capacitance is managed by changing the layer thickness of the dielectric layer. According to this method, the electrostatic capacitance can be set to any amount of electrostatic capacitance so as to obtain a cleaning effect higher than a predetermined level without changing of the other characteristic values.

Further, in the transfer device, the cleaning effect of the dielectric layer is maintained higher than a predetermined level and further the cleaning effect of the electric field can be obtained, thus more sufficiently cleaning the surface of the transfer belt.

Further, in the transfer device, the cleaning bias to be applied to a cleaning member is controlled to 300 volts or more, so that the cleaning effect of the electric field is sufficiently ensured. Further, by controlling the cleaning bias to 2500 volts or less, the cost of power to be used will not increase.

According to still another aspect of this invention, in an image formation apparatus, the transfer device is used as a transfer device, so that toner dirt stuck on an image carrier which is deposited on the transfer belt or splashed toner at the time of transfer can sufficiently be cleaned off in a state where the cleaning effect of the dielectric layer is maintained higher than a predetermined level. Thus, soil on the back of a transfer material due to imperfect cleaning of the belt, or defective transfer can be prevented from its occurrence.

According to still another aspect of this invention, a transfer device comprises a transfer conveyor belt which carries and conveys a transfer material, and a cleaning member which contacts the transfer conveyor belt to clean the surface of the belt. Further, this transfer device transfers a toner image formed on an image carrier onto the transfer material on the transfer conveyor belt. A dielectric layer is provided on the surface of the cleaning member, and surface roughness of the dielectric layer is made equal to or less than a particle diameter of toner.

According to still another aspect of this invention, in a transfer device, toner on a transfer belt moves to the surface of a dielectric layer by dielectric polarization generated on the surface of the dielectric layer due to a contact between the dielectric layer and the toner. In such a transfer device, even when a transfer conveyor belt with high resistance is used or when the amount of charge on toner is large, the surface of the transfer conveyor belt is more sufficiently cleaned as compared to that of the conventional electric-field cleaning method, and the reversed-polarity toner can also be cleaned off.

Especially, surface roughness Rz of the dielectric layer is set so as to be equal to or less than the particle diameter of the toner. According to the experiment by the inventors of this invention, when a cleaning member with such a dielectric layer is used, cleaning performance on the transfer conveyor belt by the dielectric layer can be maintained more stably and higher than a predetermined level. This is because a contact portion between toner and the dielectric layer becomes larger as compared to the case where the surface roughness Rz of the dielectric layer is larger than the toner particle diameter, which makes it possible to move a larger amount of toner to the surface of the dielectric layer.

By the way, the applicant of this invention has proposed the transfer device, as the invention of improvement according to the earlier filed application (Patent Application No. HEI 11-301773), which can maintain a cleaning effect of a dielectric layer higher than a predetermined level and effectively clean a transfer conveyor belt by specifying characteristic values of the dielectric layer, and an image formation apparatus with the transfer device (Patent Application No. HEI 11-345064 and Patent Application No. HEI 11-345069). In the transfer device and the image formation apparatus according to Patent Application No. HEI 11-345064, a dielectric layer whose dielectric constant is 3 or more is provided on a cleaning member. In the transfer device and the image formation apparatus according to Patent Application No. HEI 11-345069, a dielectric layer whose electrostatic capacitance is 100 pF or more is provided. By providing a dielectric layer with such characteristics, the amount of charge enabling deposition on the surface of the dielectric layer is sufficiently stored, and a cleaning effect of the dielectric layer can be maintained higher than a predetermined level.

The dielectric constant is a constant determined by the material of a dielectric layer, and the electrostatic capacitance is determined by the dielectric constant and the layer thickness of the dielectric layer. Therefore, the inventors of this invention have carried out studies on a layer thickness with which electrostatic capacitance satisfies the range when a dielectric layer made with a nylon-base material whose dielectric constant is 11 is used. As a result, it has been clear that if the layer thickness of the dielectric layer is 1000 $\mu$m or less, the amount of charge enabling deposition on the surface of the dielectric layer can sufficiently be stored and the cleaning effect of the dielectric layer can also be maintained higher than a predetermined level.

Therefore, in this particular transfer device, a dielectric layer formed with a nylon-base material whose dielectric constant is 11 and whose layer thickness is 1000 $\mu$m or less is provided. By using such a dielectric layer, the amount of charge enabling deposition on the surface of the dielectric layer can sufficiently be stored, and the cleaning effect of the dielectric layer can be maintained higher than a predetermined level.

Since durability of the dielectric layer is reduced by making the layer thickness of the dielectric layer thinner, it is not desirable to make the layer thickness too thin. According to the experiments by the inventors of this invention, it has been ascertained that the durability of the dielectric layer becomes insufficient when a dielectric layer made with the nylon-base material with its dielectric constant of 11 is used and its layer thickness is set to 60 $\mu$m or less. However, the layer thickness of the dielectric layer can be made thinner by improving the durability by taking measurements for abrasion resistance of the dielectric layer.

According to still another aspect of this invention, in a transfer device, even when a transfer conveyor belt with high resistance is used or the amount of charge on toner is large, the surface of the transfer conveyor belt can be cleaned more sufficiently as compared to the conventional electric-field cleaning method and reversed-polarity toner can also be cleaned off the belt by the same effects as those of the transfer device as explained above.

In this transfer device, by press-fitting a roller-shaped member into a hollow section of the dielectric tube, adhesion between the two can be promoted without using an adhesive. Therefore, the dielectric tube does not possibly slip at the time of rotation of the roller-shaped member, thus preventing imperfect cleaning of the transfer conveyor belt due to such slip.

Even in the transfer device, mechanical characteristics of the dielectric tube vary according to variations in temperature or humidity and a high degree of adhesion between the dielectric tube and the roller-shaped member can not be maintained, therefore, the possibility that the dielectric layer slips may increase.

Further, in this transfer device, in order to solve the problem, movement of the dielectric tube is restricted in the axial and peripheral direction of the roller-shaped member by tapered extending sections. Accordingly, the possibility that the dielectric tube slips can be decreased more reliably. Thus, occurrence of the slip can be suppressed even when the adhesion between the dielectric tube and the roller-shaped member decreases due to variations in temperature or humidity.

Further, in this transfer device, a bias electric field which allows toner to move toward a cleaning member is produced by the bias application unit between the cleaning member and the transfer conveyor belt. Therefore, a cleaning effect of the bias electric field can also be attained in a state where cleaning performance on the transfer conveyor belt by the dielectric layer is sufficiently maintained. Thus, the surface of the transfer conveyor belt can be more sufficiently cleaned.

Especially, when the bias application unit is provided in the transfer device, because the surface of the dielectric layer provided on the surface of the cleaning member is comparatively smooth, density of a line of electric force in the bias electric field near the surface of the dielectric layer becomes comparatively denser. Thus, the cleaning effect of the bias electric field can more effectively be attained.

When the bias application unit is provided in the transfer device in particular, a high degree of adhesion between the dielectric tube and the roller-shaped member can be obtained, and an air layer may not possibly be formed between the two. Therefore, electric nonuniformity on the cleaning member due to the air layer may not occur. Thus, imperfect cleaning of the transfer conveyor belt due to electric nonuniformity on the cleaning member can be prevented.

When the bias application unit is provided in the transfer device in particular, the roller-shaped member to which a cleaning bias is applied is covered with the dielectric tube with the extending sections, therefore, the roller-shaped member and the transfer conveyor belt do not directly contact each other even at both ends of the roller-shaped member in its axial direction. Thus, a leak of a cleaning bias due to a contact between the roller-shaped member and the transfer conveyor belt can surely be prevented.

According to still another aspect of this invention, in an image formation apparatus, by using the transfer device as a transfer device, toner dirt stuck on an image carrier which is deposited on a transfer conveyor belt or splashed toner at the time of transfer can sufficiently be cleaned off in a state where sufficient cleaning performance is delivered on the transfer conveyor belt. Thus, soil on the back of a transfer material due to imperfect cleaning of the belt, or defective transfer can be prevented from its occurrence.

Other objects and features of this invention will become understood from the following description with reference to the accompanying drawings.

DESCRIPTION OF THE PREFERRED EMBODIMENTS

Preferred embodiments of this invention applied to an electronic photocopier (hereafter referred to as copier) as an image formation apparatus will be explained below.

Figure 1:
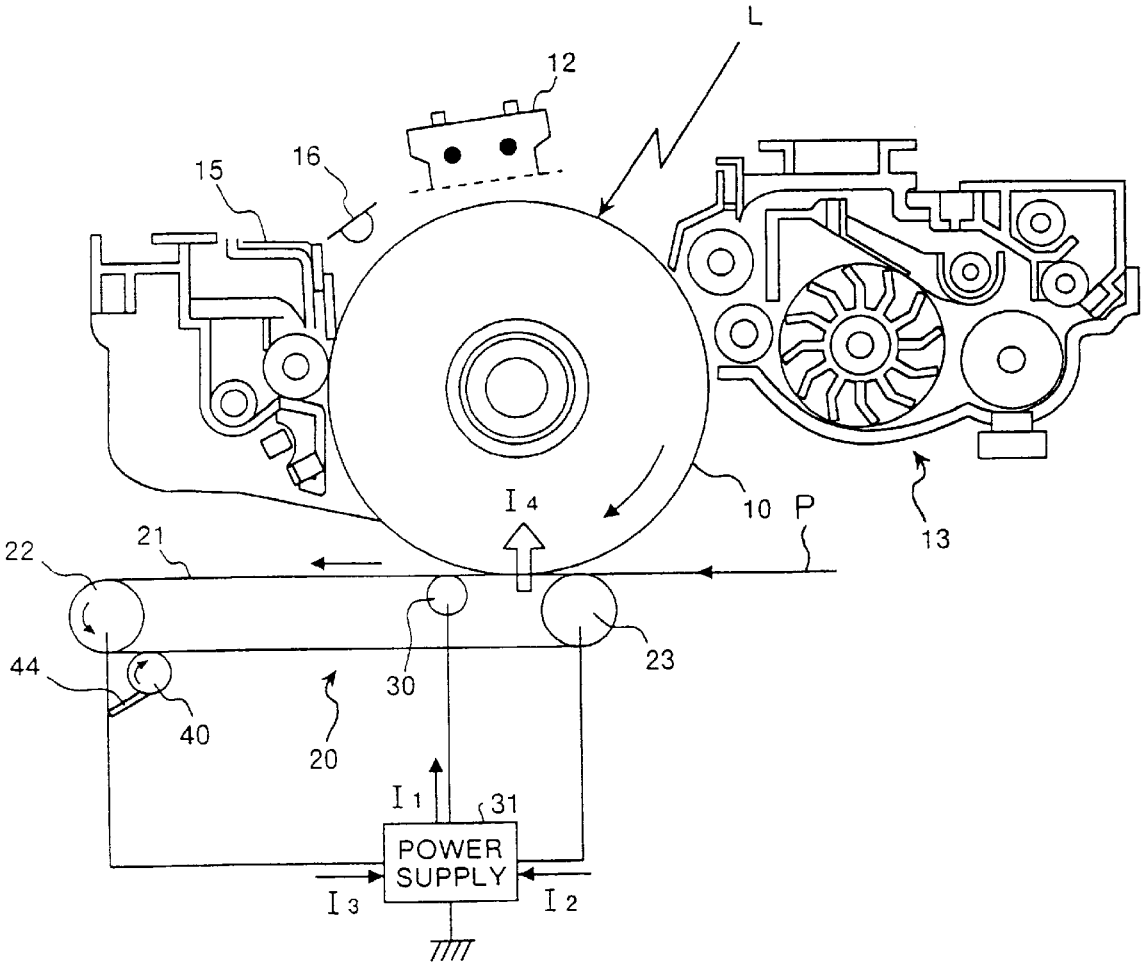
FIG. 1 is a schematic diagram of a copier according to an embodiment of this invention.

A configuration and operation of the overall copier will be explained first. FIG. 1 is a schematic diagram of the copier. In FIG. 1, a photosensitive drum 10 as an image carrier is rotatably attached to the copier. A charging device 12, an exposure device not shown, a development device 13 as a toner image formation unit that forms a toner image on the photosensitive drum, a cleaning device 15, a deelectrification device (deelectrification lamp) 16, or the like are arranged around the photosensitive drum 10. A transfer device 20 is provided under the photosensitive drum 10.

The transfer device 20 is supported by a drive roller 22 and a driven roller 23 as rotors, and has a transfer belt 21 that carries and conveys transfer paper P as a transfer material. These drive roller 22 and driven roller 23 are conductive rollers such as metal, and grounded, respectively. A transfer bias roller 30 and a cleaning roller 40 as a cleaning member, that contacts the surface of the transfer belt 21 to clean it, or the like, are provided around the transfer belt 21.

The transfer belt 21 a high-resistance belt obtained by coating the surface of an endless belt made of a rubber member with a fluorine-base material, and its volume resistivity is $10^{14}$ ohm-cm. Further, the transfer belt 21 is designed so that the transfer belt 21 rotates in the direction indicated by an arrow in the figure, contacts the photosensitive drum 10 by raising a lifting lever not shown, and is off the photosensitive drum 10 by the lifting lever after transfer is finished.

As shown in FIG. 1, a constant-current power supply 31 that outputs an output current $I_1$ for transfer is connected to the transfer bias roller 30, and this transfer bias roller 30 and the constant-current power supply 31 form a charge application unit for applying a plus charge for transfer as a reverse polarity to an electric charge polarity of toner to the transfer belt 21. A part of the charge supplied from the transfer bias roller 30 to the transfer belt 21 flows into the drive roller 22 and the driven roller 23, and is returned to the constant-current power supply 31 as feedback currents $I_2$ and $I_3$. Further, the output current $I_1$ is controlled so as to obtain a relation represented by the following equation, so that an effective transfer current $I_4$ dedicated to transfer flowing to the photosensitive body 10 becomes a constant current in a transfer area where the photosensitive drum 10 and the transfer belt 21 are opposite to each other and contact each other.

$$I_4=I_1-I_2-I_3$$

Based on the configuration, the surface of the photosensitive drum 10 is charged uniformly by the charging device 12, and irradiated with a light signal L from the exposure device to form an electrostatic latent image. This electrostatic latent image is developed by the development device 13 and a toner image is formed as a visible image. In this embodiment, negatively charging toner with styrene acrylic as a base material is used.

A transfer electric field is formed in the transfer area by the transfer bias roller 30, the toner image on the photosensitive drum 10 is transferred onto the transfer paper P on the transfer belt 21, and the transfer paper P is conveyed to a fixture device not shown and fixed.

On the other hand, some remaining toner is cleaned off the surface of the photosensitive drum 10 by the cleaning device 15 after the toner image is transferred, and a residual charge is then deelectrified by the deelectrification device 16 for the next charge.

Cleaning of the transfer belt 21 is explained below.

Figure 2:
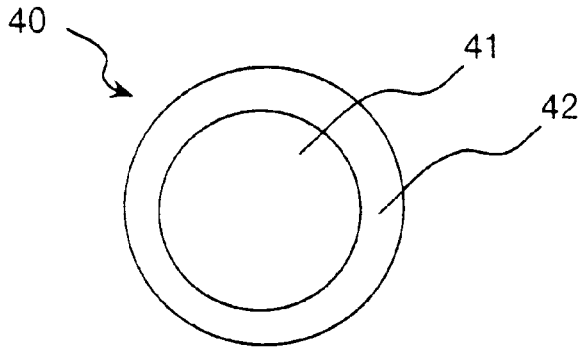
FIG. 2 is a cross-sectional view of a cleaning roller incorporated in the copier.

In FIG. 1, the surface of the transfer belt 21 is cleaned by the cleaning roller 40. This cleaning roller 40 is obtained, as shown in FIG. 2, by coating the external periphery of a core metal 41 (outer diameter ϕ12) as a base body of the roller with an elastic body layer 42 with a layer thickness of about 100 μm. In this embodiment, a tube made with a nylon-base material in which carbon black as a resistance control agent is dispersed is used as the dielectric layer 42, but the tube may be coated with a dielectric material, for example. The cleaning roller 40 is embedded to the transfer belt 21 by approx. 1 mm and rotated in the direction indicated by the arrow in FIG. 1 at the equal speed to that of the transfer belt 21. In this embodiment, a hard roller whose base material is core metal 41 is used as a cleaning roller 40. However, a soft roller whose base material is an elastic body, for example, is used, and the soft roller is provided opposite to the drive roller 22 and a lining member that is provided separately, so that the soft roller may be embedded to the transfer belt 21. Further, by pressing the side of the transfer belt 21 with the lining member provided on the inner peripheral surface of the belt regardless of the hard roller or the soft roller, the transfer belt 21 may contact the cleaning roller 40.

Based on this configuration, when the dielectric layer 42 on the surface of the cleaning roller 40 and the negatively charging toner on the transfer belt 21 contact each other, a 40l reverse polarity to the electric charge polarity of toner, that is, a positive charge is induced on the surface of the dielectric layer 42 by dielectric polarization to generate electrostatic absorption force between the dielectric layer 42 and the toner. At this time, electrostatic absorption force between the dielectric layer and the toner (hereafter referred to as dielectric absorption force) and electrostatic absorption force between the transfer belt 21 and the toner (hereafter referred to as belt absorption force) act on the layered toner between the transfer belt 21 and the dielectric layer 42. However, each magnitude of the respective electrostatic absorption force acting on the toner varies inversely with the square of the distance to the toner, therefore, the dielectric absorption force is stronger than the belt absorption force with respect to the toner on the top layer of the surface of the transfer belt 21. Accordingly, the toner on the top layer of the transfer belt 21 moves to the dielectric layer side, so that the toner is cleaned off the transfer belt. Further, since an electric charge of the opposite polarity to the electric charge polarity of the toner is always induced on the surface section of the dielectric layer 42, the toner whose electric charge polarity is reversed can also be moved toward the surface of the dielectric layer.

The dielectric absorption force is then maintained, and at the same time a bias electric field which allows toner to move toward the cleaning roller 40 side is formed in the toner caused by the potential difference between the cleaning roller 40 and the transfer belt 21 by the constant-current power supply 31. Accordingly, a part of the toner on the transfer belt 21 moves to the surface of the dielectric layer 42 by the dielectric absorption force. While some other part of the toner moves to the surface of the dielectric layer 42 by the bias electric field. The toner moved to the surface of the dielectric layer 42 of the cleaning roller 40 is scratched by a rubber blade 44 and collected.

Based on the configuration, as explained above, a larger amount of toner can be cleaned off by a cleaning effect based on the dielectric layer 42 and a cleaning effect based on the electric field, which allows the surface of the transfer belt 21 to sufficiently be cleaned.

In order to obtain such a high degree of cleaning performance, it is required to specify characteristic values of the dielectric layer 42 provided on the surface of the cleaning roller 40. For example, when the volume resistivity and the surface resistivity of the dielectric layer 42 are too small, the dielectric layer 42 exhibits electric conductivity. Therefore, dielectric polarization due to a contact between the dielectric layer and the toner will hardly be generated, and the cleaning effect of the dielectric layer 42 is reduced, which may cause inconvenience such that only the cleaning effect of the electric field can be obtained to come up. Further, when the volume resistivity and the surface resistivity of the dielectric layer 42 are too small, there may occur inconvenience such that dielectric breakdown will occur in the thickness direction of the dielectric layer 42 if a cleaning bias to be applied to the cleaning roller is increased in order to improve the cleaning effect of the electric field.

These inconveniences can be eliminated by setting the volume resistivity of the dielectric layer 42 to 1E3 ohm-cm or more or setting the surface resistivity to at least 1E4 ohms/square so that the electric conductivity of the dielectric layer 42 can be prevented from its being too high. Further, the dielectric breakdown of the dielectric layer 42 due to the cleaning bias can be prevented. The value of the volume resistivity (ohm-cm) is obtained from the resistance (ohm) measured under the conditions of applied voltage: 25 volts and timer: 10 seconds by using measuring equipment manufactured by YHP (product name: High Resistance Meter: 4329A). While the value of the surface resistivity (ohms/square) is obtained under the conditions of applied voltage: 100 volts and timer: 10 seconds by using measuring equipment manufactured by Mitsubishi Chemical Co. (product name: Hiresta, Probe: HA).

On the other hand, when the volume resistivity of the dielectric layer 42 is too large, the insulating capability of the dielectric layer 42 is too high. Therefore, the bias electric field produced between the cleaning roller 40 and the transfer belt 21 becomes insufficient, which may cause reduction of the cleaning effect of the electric field. However, if the volume resistivity is set to at most 1E15 ohm-cm, the bias electric field can sufficiently be ensured and the cleaning effect of the electric field can also be maintained higher than a predetermined level.

An upper limit of the surface resistivity does not particularly need to be specified. However, when a single-layer transfer belt 21 is used like in this embodiment, the volume resistivity becomes larger in association with increased surface resistivity of the dielectric layer 42. Therefore, the upper limit of the surface resistivity may be set considering the upper limit of the volume resistivity.

When the dielectric constant of the dielectric layer 42 is too small, electrostatic capacitance becomes too small, so that charge amounts, that is, the amount of toner that is allowed to be deposited to the surface of the dielectric layer is decreased, and the cleaning effect of the dielectric layer 42 may be reduced. However, by setting the dielectric constant of the dielectric layer 42 so as to be larger than 3, the electrostatic capacitance can sufficiently be stored and the cleaning effect of the dielectric layer 42 can be maintained higher than a predetermined level. The dielectric constant is obtained through the equation described below from the electrostatic capacitance (F) obtained under the conditions of DC bias: 0 volt, frequency: 1000 Hz, and timer: 10 seconds by using measuring equipment manufactured by YHP (product name: Auto Capacitance Bridge: 4270A).

$$\in s = C \cdot d / \in 0 \cdot S$$

($\in$s: dielectric constant of a dielectric, S: area of the dielectric, D: layer thickness of the dielectric, $\in$0: dielectric constant under vacuum).

An upper limit of the dielectric constant does not particularly need to be specified as well. However, when the single-layer transfer belt 21 is used like in this embodiment, the volume resistivity becomes smaller in association with increased dielectric constant of the dielectric layer 42. Therefore, the upper limit of the dielectric constant may be set considering the lower limit of the volume resistivity.

As for the dielectric constant, the same effect can be obtained by setting a value in the range even if a cleaning bias is not applied to the cleaning roller 40.

In order to move toner to the surface of the dielectric layer 42 more reliably, a bias application unit, that applies a cleaning bias of the opposite polarity to an electric charge polarity of the toner to the cleaning roller 40, may be additionally provided in the configuration shown in FIG. 1.

Figure 3:
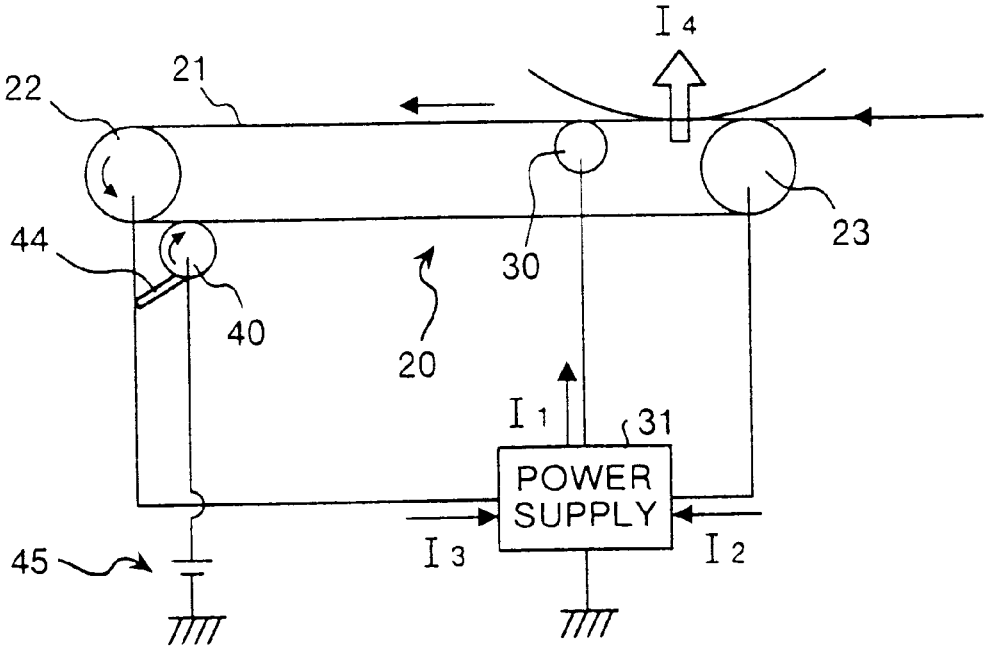
FIG. 3 is a schematic diagram of another example of a configuration of a transfer device in the copier.

FIG. 3 shows an example of the configuration of the transfer device 20 with the bias application unit. A constant-voltage power supply 45 as a bias application unit is connected to the core metal 41 of the cleaning roller 40, so that a plus 400-V bias, for example, is applied to the metal. In the example shown in the figure, the constant-voltage power supply 45 is provided as a bias application unit separately from the constant-current power supply 31 as a charge application unit for transfer. However, in order to more accurately control transfer current $I_4$ to the photosensitive drum 10, the constant-current power supply 31 may also double as a power source as a bias application unit to the cleaning roller 40.

In the example of the configuration in FIG. 3, the dielectric absorption force can be maintained and at the same time a bias electric field which allows toner to move toward the cleaning roller 40 is formed in the toner caused by the difference potential between the cleaning roller 40 and the transfer belt 21 due to the constant-current power supply 31. Accordingly, a part of the toner on the transfer belt 21 moves to the surface of the dielectric layer 42 by the electrostatic force. While some other part of the toner moves to the surface of the dielectric layer 42 by the bias electric field. As explained above, a larger amount of toner can be cleaned off by the dielectric absorption force and the electrostatic force due to the bias electric field, which allows the surface of the transfer belt 21 to sufficiently be cleaned. At this time, since the dielectric layer 42 is provided on the surface of the cleaning roller, a cleaning bias is not applied to the toner, therefore, there is no possibility to generate reversely charged toner as well.

In order to obtain such a high degree of cleaning performance, it is required to adequately set a value of electrostatic capacitance of the dielectric layer 42 provided on the surface of the cleaning roller 40 in the configuration of FIG. 1 and FIG. 3. When the electrostatic capacitance of the dielectric layer 42 is too small, charge amounts, that is, the amount of toner that is allowed to be deposited on the surface of the dielectric layer is decreased regardless of whether a cleaning bias is applied to the toner, and the cleaning effect of the dielectric layer 42 may be reduced.

Such inconvenience can be eliminated by setting the electrostatic capacitance of the dielectric layer 42 to at least 100 pF so that the amount of charge enabling deposition on the surface of the dielectric layer 42 can sufficiently be stored and the cleaning effect of the dielectric layer 42 can also be maintained higher than a predetermined level. The value of the electrostatic capacitance (pF) is obtained under the conditions of DC bias: 0 volt, frequency: 1000 Hz, and timer: 10 seconds by using measuring equipment manufactured by YHP (product name: Auto Capacitance Bridge: 4270A).

It is desirable to manage the value of the electrostatic capacitance by controlling the layer thickness of the dielectric layer 42. According to this configuration, the electrostatic capacitance can easily be managed to obtain the cleaning effect higher than a predetermined level without varying of another characteristic values such as the volume resistivity and the surface resistivity of the dielectric layer. In order to increase the value of the electrostatic capacitance, it is conceivable that the layer thickness of the dielectric layer is made thinner, but it is required to set the value in a range in which the durability of the dielectric layer and the accuracy of the layer thickness will not be degraded.

Further, when a cleaning bias is to be applied, it is desirable to set volume resistivity of the dielectric layer in a range from 1E3 to 1E15 ohm-cm and the surface resistivity to 1E4 ohms/square or more. If the value is within the range, either one of the electric conductivity and the insulation of the dielectric layer 42 will not become excessively high. Therefore, the cleaning effect of the dielectric layer 42 and the cleaning effect of the electric field can be maintained higher than a predetermined level.

A result of evaluating the cleaning performance will be explained below when 10,000 copies (A4 in landscape orientation) are made by the copier in FIG. 1 and cleaning is carried out using the cleaning roller 40 on which the dielectric layer 42, whose characteristic values are within the ranges explained below, is provided.

Volume resistivity: 1E3 to 1E15 ohm-cm

Surface resistivity: 1E4 to 1E15 ohms/square

Dielectric constant: 3 to 30

Electrostatic capacitance: 100 to 7000 pF

The cleaning performance is evaluated with a value of optical density (ID) of toner on a tape. More specifically, the value is obtained by transferring residual toner on the transfer belt 21 after being cleaned onto both sides of the tape that is a colorless transparent adhesive tape, and measuring the optical density (ID) of the toner on the tape using a Macbeth densitometer. Smaller optical density (ID) represents a higher degree of cleaning performance. It should be noted that a cleaning bias of plus 500V is applied.

As a result of this evaluation, it has been ascertained that, when the respective characteristic values of the dielectric layer 42 are within the ranges, the optical density is smaller than the optical density (ID) of 1.3 in a case where the dielectric layer is not provided and the cleaning effect of the dielectric layer 42 higher than a predetermined level can be obtained.

Within the ranges, the optical density is 0.01 in the ranges of the volume resistivity: 1E7 to 1E14 ohm-cm, the surface resistivity: 1E6 to 1E13 ohms/square, the dielectric constant: 6 to 25, and the electrostatic capacitance: 500 to 2000 pF. Therefore, the cleaning effect of the dielectric layer 42 and the cleaning effect of the electric field can sufficiently be delivered, so that it has been possible to ascertain that more excellent cleaning performance can be obtained. Especially, when the volume resistivity of the dielectric layer 42 is 2E9 ohm-cm, the surface resistivity is 4E10 ohms/square, the dielectric constant is 11, and the electrostatic capacitance is 1000 pF, the maximum effect can be obtained.

In this evaluation, it was ascertained that the cleaning effect of the electric field could sufficiently be obtained if the cleaning bias to be applied to the cleaning roller was 300 volts or more. However, if the cleaning bias is made too large, the cost of power to be used increases, therefore, it is appropriate that its upper limit is about 2500 volts.

As explained above, according to this embodiment, it is possible to effectively clean toner dirt stuck on the photosensitive drum 10 which is deposited on the transfer belt 21 or splashed toner at the time of transfer in a state where the cleaning effect of the dielectric layer 42 provided on the surface of the cleaning roller 40 is maintained higher than a predetermined level. Accordingly, it is possible to form an excellent image without occurrence of soil on the back of transfer paper P due to imperfect cleaning of the transfer belt 21 or defective transfer.

In order to maintain such excellent cleaning performance for the transfer conveyor belt 21, it is required to appropriately select a material for the dielectric layer 42. The inventors of this invention focused attention on surface roughness Rz of the dielectric layer 42 and a diameter of a toner particle. They carried out experiments about cleaning performance of residual toner on the transfer conveyor belt 21 using combinations of various materials concerning the above characteristics.

Experiment 1

In this experiment, the cleaning performance, when 100 copies (A4 in landscape orientation) were made in the copier of FIG. 1 and cleaning was carried out using the cleaning roller 40, was evaluated. The result of the experiment is shown in Table 1 described below.

The cleaning performance was evaluated by transferring the residual toner on the transfer conveyor belt 21 after being cleaned onto both sides of a tape that was a colorless and transparent adhesive tape, measuring the optical density (ID) of the toner on the tape measured using the Macbeth densitometer, and using the density difference (ΔID) based on the optical density (ID) of an adhesive tape before being cleaned as a reference. That is, it is shown that the cleaning performance is higher when ΔID is smaller.

Further, the configuration of FIG. 3 was used in this experiment and plus-1000 V as a cleaning bias was applied to the cleaning roller 40. A nylon-base tube with a layer thickness of 100 $\mu$m having the characteristic values as follows was used.

Volume resistivity: $2\times10^{9}$ ohm-cm

Surface resistivity: $4\times10^{10}$ ohms/square

Dielectric constant: 11

Electrostatic capacitance: 1000 pF (Table 1 of 9905232)

According to Table 1, it is clear that excellent cleaning performance can be obtained by using any dielectric layer whose surface roughness Rz is equal to or smaller than a particle diameter of toner. This is because a larger amount of toner can be moved to the surface of the dielectric layer since a contact part between the toner and the dielectric layer becomes wider as compared to the case where the surface roughness Rz of the dielectric layer is larger than the particle diameter of the toner. Accordingly, it is desirable to use a dielectric layer 42 whose surface roughness Rz is equal to or larger than the particle diameter of the toner. By providing the dielectric layer 42 made with a material having such surface roughness Rz on the core metal 41 of the cleaning roller 40, the cleaning performance on the transfer conveyor belt can be maintained more stably and higher than a predetermined level, and the transfer conveyor belt 21 can effectively be cleaned.

If the dielectric layer 42 having such surface roughness Rz is used, the toner moved to the surface of the cleaning roller 40 will not possibly enter into pits on the surface. Therefore, it is possible to sufficiently clean the surface of the cleaning roller 40 by the rubber blade 44, which allows the transfer conveyor belt 21 to be cleaned in a state where the cleaning roller is always kept clean.

Further, if the dielectric layer 42 with such surface roughness Rz is used in the transfer device 20 in which the bias application unit of FIG. 3 is provided, a line of electric force in the bias electric field near the surface of the dielectric layer 42 becomes comparatively denser. Therefore, it is possible to more effectively attain the cleaning effect of the bias electric field.

Experiment 2

As shown in the earlier filed applications (Patent Application No. HEI 11-345064 and Patent Application No. HEI 11-345069), as a dielectric layer 42, it is desirable to use a dielectric layer whose dielectric constant is 3 or more and electrostatic capacitance is 100 pF or more. The dielectric constant is a constant that is determined by a material of the dielectric layer, while the electrostatic capacitance is determined by the dielectric constant and the layer thickness of the dielectric layer 42. Therefore, the inventors of this invention carried out experiments about which layer thickness should be for electrostatic capacitance satisfying the ranges when the dielectric layer made with the nylon-base material whose dielectric constant was 11 was used. The result of the experiment is shown in Table 2.

In this experiment, the particle diameter of toner used for image formation is 9.5 μm, and the method for evaluating cleaning performance and the characteristic values other than the electrostatic capacitance of the dielectric layer 42 are the same as those in the first experiment.

(Table 2 of 9905232)

According to Table 2, when a dielectric layer 42 made with a nylon-base material whose dielectric constant is 11 is used, it has been clear that electrostatic capacitance of 100 pF or more can be ensured if the layer thickness of the dielectric layer 42 is 1000 μm or less. Further, it has been also ascertained that excellent cleaning performance can be obtained by using such a dielectric layer 42. As explained above, by providing the dielectric layer 42 made with a nylon-base material whose dielectric constant is 11 and layer thickness is 1000 μm or less on the core metal 41 of the cleaning roller 40, the amount of charge enabling deposition on its surface can sufficiently be stored and the cleaning effect of the dielectric layer can also be maintained higher than a predetermined level.

A dielectric layer 42 made with the nylon-base material whose dielectric constant is 11 and layer thickness is 1000 μm or less is provided on the core metal 41 of the cleaning roller 40 for the transfer device 20 constructed as shown in FIG. 3. Accordingly, a high degree of adhesion between the dielectric layer 42 and the core metal 41 is obtained, and because an air layer may not be formed between the two, electric nonuniformity on the cleaning roller 40 due to the air layer may not occur. Thus, imperfect cleaning of the transfer conveyor belt 21 caused by the electric nonuniformity on the cleaning roller 40 can be prevented.

Since the layer thickness of the dielectric layer 42 is made thinner, the durability of the dielectric layer is getting worse, it is not desirable to make the layer thickness excessively thinner. In this experiment, when the layer thickness was 60 μm, displacement between the dielectric layer 42 and the core metal 41 occurred, so that the durability of the dielectric layer 42 became insufficient. Considering the durability, the layer thickness of 80 μm indicated in the conditions 20 is the most preferable condition in this experiment. Even in the case of cleaning after 1 million copies were made by the copier, the same degree of cleaning performance could be maintained.

In this embodiment, as explained above, the core metal 41 of the cleaning roller 40 is coated with a tube (hereafter referred to as dielectric tube 42) made with a nylon-base material as a dielectric layer 42. In this case, if the degree of adhesion between the core metal 41 and the dielectric tube 42 is low, the dielectric tube 42 does not follow rotation of the roller but may slip. When the slip caused by such a low degree of adhesion occurs, imperfect cleaning of the transfer conveyor belt 21 occurs. In order to keep a high degree of adhesion between the dielectric tube 42 and the core metal 41, it is conceivable to bond both of them with an adhesive, but this method has some disadvantages that application of the adhesive makes the two awkward to be handled at the time of manufacturing, or electric nonuniformity may occur on the cleaning roller depending on the adhesives, which should be avoided.

Therefore, as a cleaning roller 40, it is desirable to use one with the core metal 41 press-fitted into a hollow section of the dielectric tube 42. In this embodiment, a core metal whose outer diameter ϕ of 12 is press-fitted into the dielectric tube 42 whose inner diameter ϕ is 11.4 and radial thickness is 80 μm. According to the conditions, the adhesion between the dielectric tube 42 and the core metal 41 can be promoted without using the adhesive. Therefore, the tube 42 does not possibly slip during rotation of the cleaning roller 40, and imperfect cleaning of the transfer conveyor belt 21 due to such slip can be prevented.

Figure 4:
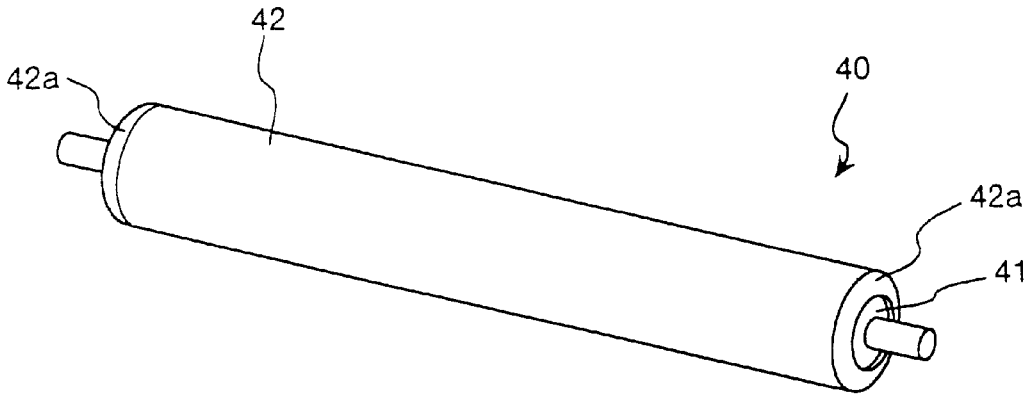
FIG. 4 is a perspective view of the cleaning roller.
Figure 5:
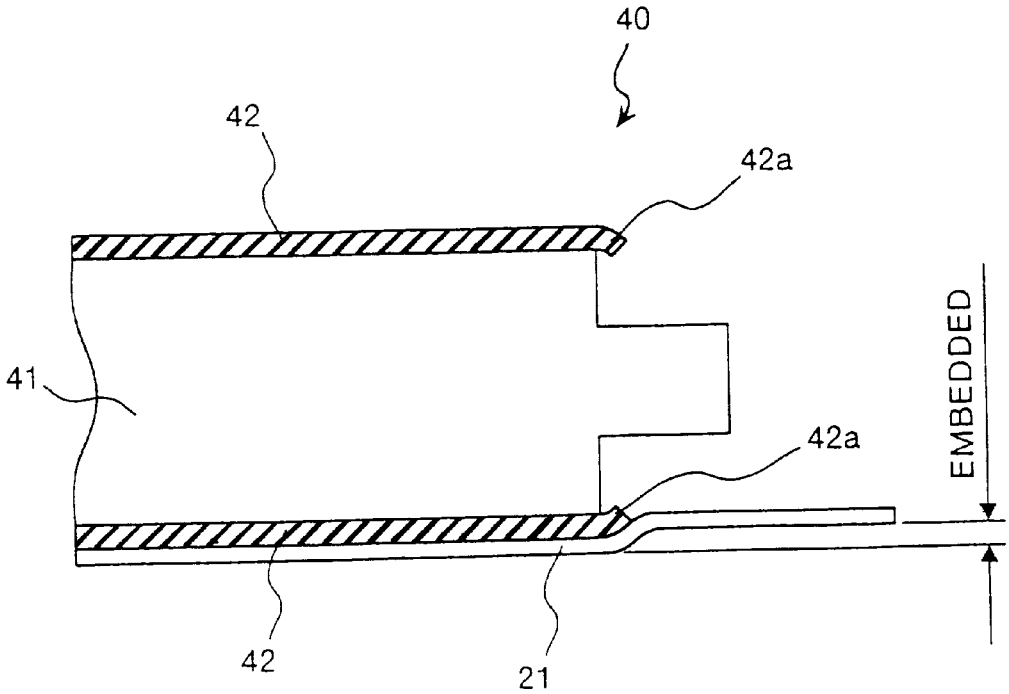
FIG. 5 is a cross-sectional view of the cleaning roller in its axial direction.

In order to decrease the possibility more reliably that the dielectric tube 42 slips, as shown in FIG. 4 and FIG. 5, the dielectric tube 42 has outwardly extending sections 42*a* at both ends of the core metal 41, and-the shape of the extending sections 42*a* may be tapered so that its diameter is getting smaller as approaching the both ends of the tube 42 in its width direction. Movement of the dielectric tube 42 in an axial direction and peripheral direction of the core metal 41 is restricted by such tapered extending sections 42*a*. Thus, the possibility that the tube 42 slips can be decreased more reliably. Accordingly, occurrence of the slip can be suppressed when the adhesion between the dielectric tube 42 and the core metal 41 is decreased due to variations in temperature or humidity, for example.

Figure 8:
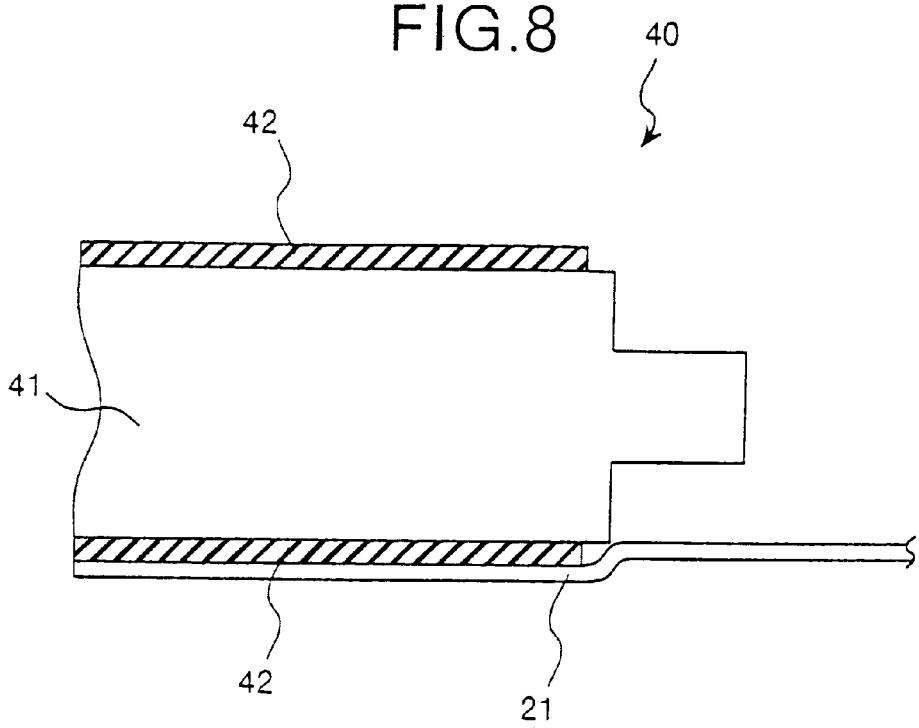
FIG. 8 shows inconvenience of a dielectric layer covering the cleaning roller.

By using the dielectric tube 42 having such tapered extending sections 42*a* for the transfer device 20 with the bias application unit of FIG. 3, both ends of the core metal 41 of the cleaning roller 40 in its axial direction and the transfer conveyor belt 21 do not directly contact each other. That is, different from the configuration in which both ends of the core metal 41 in its axial direction are exposed as shown in FIG. 8, all the portion where the core metal 41 contacts the transfer conveyor belt 21 is covered with the dielectric tube 42. Thus, a cleaning bias leak due to a contact between the core metal 41 of the cleaning roller 40 and the transfer conveyor belt 21 can surely be prevented.

Figure 9:
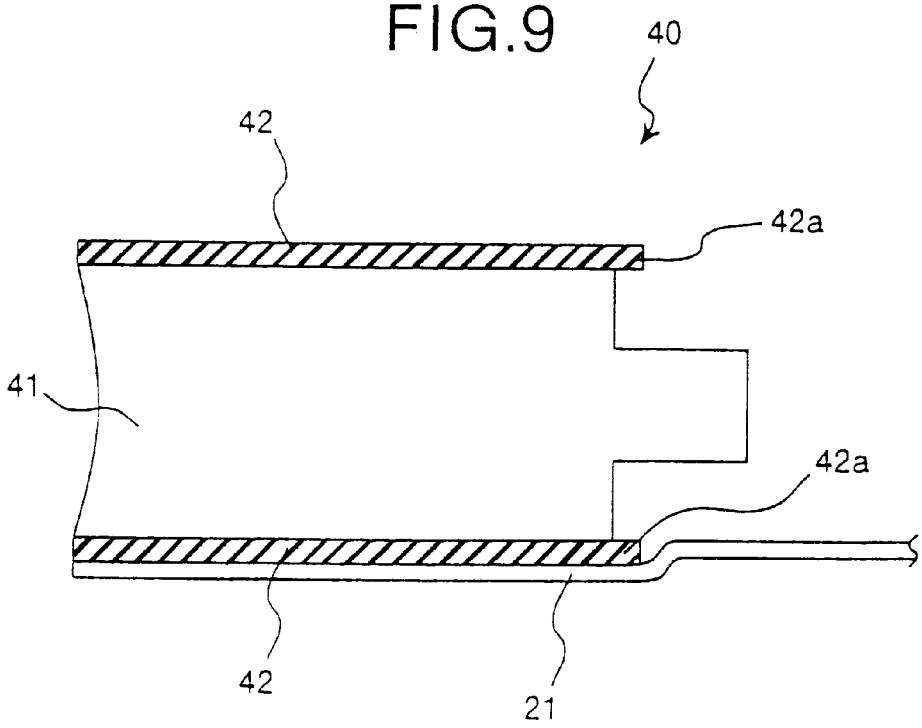
FIG. 9 shows another type of inconvenience of the dielectric layer covering the cleaning roller.

Further, when the dielectric tube 42 with the tapered extending sections 42*a* is used, the transfer conveyor belt 21 can be prevented from its being damaged. For example, when the extending sections 42*a* of the dielectric tube 42 are not tapered as shown in FIG. 9, each edge of the extending sections 42*a* and the transfer conveyor belt 21 rub against each other at the time of a contact between them. Depending on the hardness of the extending section 42*a*, the transfer conveyor belt 21 may be damaged. However, if the extending sections 42*a* are made tapered, the transfer conveyor belt 21 may not be rubbed by the edges of the extending sections 42*a*, thus preventing occurrence of such damage to the transfer conveyor belt 21.

Figure 6:
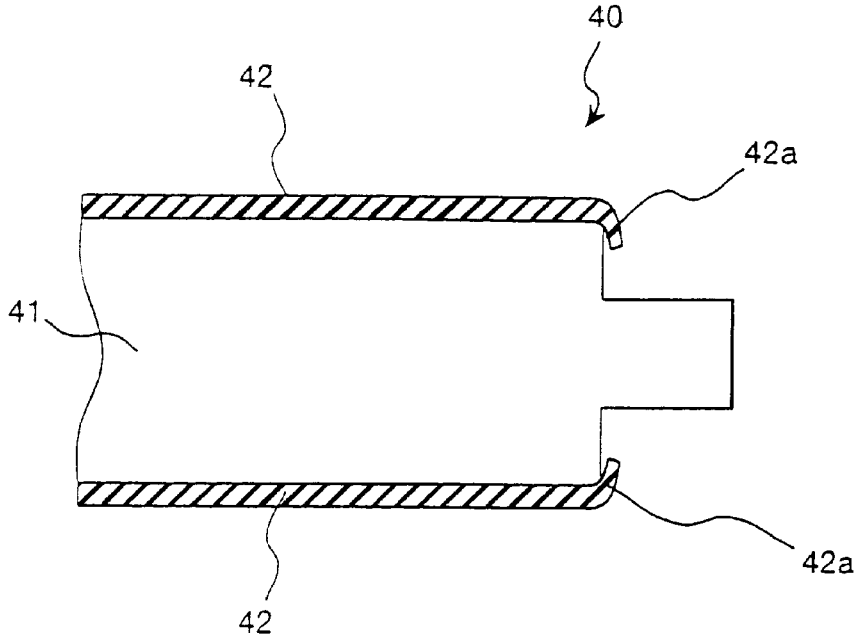
FIG. 6 is a cross-sectional view of another example of the configuration of the cleaning roller in its axial direction.
Figure 7:
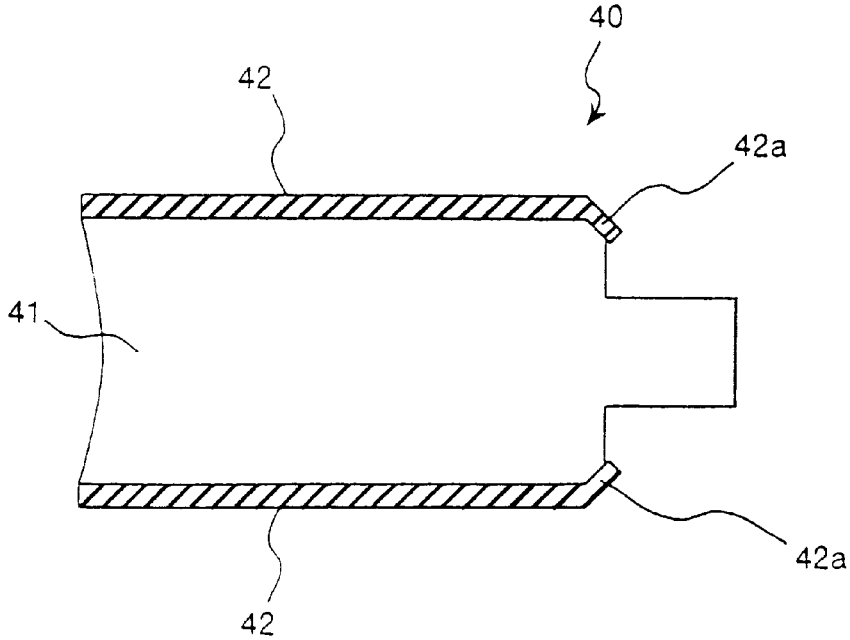
FIG. 7 is a cross-sectional view of still another example of the configuration of the cleaning roller in its axial direction.

When the core metal 41 formed as shown in the cross-sectional view of FIG. 5 is used, as the core metal 41 of the cleaning roller 40, and further when the core metal 41 with a curved chamfer R on the edge as shown in FIG. 6 or the core metal 41 with a plane chamfer C on the edge as shown in FIG. 7 is used, the same effect can also be obtained by providing the tapered extending sections 42*a*.

As explained above, according to this embodiment, the cleaning performance on the transfer conveyor belt 21 based on the dielectric layer 42 can be maintained higher than a predetermined level, and imperfect cleaning of the transfer conveyor belt caused by defect in adhesion between the dielectric layer 42 and the core metal 41 can be prevented. Thus, an excellent image can be formed without occurrence of soil on the back of a transfer material due to imperfect cleaning of the transfer conveyor belt 21, or of defective transfer.

According to this invention, characteristic values of the dielectric layer provided on the surface of the cleaning member are specified, so that a cleaning effect of the dielectric layer can be maintained higher than a predetermined level, thus effectively cleaning the transfer belt.

According to the invention in particular, the volume resistivity of the dielectric layer is set to 1E3 ohm-cm or more, so that the cleaning effect of the dielectric layer can be maintained higher than a predetermined level, and further, dielectric breakdown of the dielectric layer due to a cleaning bias can be prevented.

According to the invention in particular, the volume resistivity of the dielectric layer is set to 1E15 ohm-cm or less, so that, in addition to the cleaning effect of the dielectric layer, the cleaning effect of the electric field can also be maintained higher than a predetermined level, thus more effectively cleaning the transfer belt.

According to the invention in particular, the cleaning effect of the electric field can sufficiently be ensured and the cost of power to be used can also be suppressed.

According to the invention in particular, the cleaning effect of the electric field is added, so that the surface of the transfer belt can be more sufficiently cleaned.

According to this invention, an excellent image can be formed without occurrence of soil on the back of a transfer material due to imperfect cleaning of the transfer belt, or of defective transfer.

According to these inventions, the electrostatic capacitance of the dielectric layer provided on the surface of a cleaning member is set to 100 pF or more, so that the cleaning effect of the dielectric layer can be maintained higher than a predetermined level, thus effectively cleaning the transfer belt.

The value of the electrostatic capacitance can be managed without changing the other characteristic values by changing the layer thickness of the dielectric layer. Thus, the dielectric layer to obtain the cleaning effect higher than the predetermined level can easily be managed.

According to the invention in particular, the cleaning effect of the electric field is added, so that the surface of the transfer belt can be more sufficiently cleaned.

According to the invention in particular, the cleaning effect of the electric field can sufficiently be ensured and the cost of power to be used can also be suppressed.

Further, according to this invention, an excellent image can be formed without occurrence of soil on the back of a transfer material due to imperfect cleaning of the transfer belt or defective transfer.

According to this invention, the surface roughness of the dielectric layer provided on a cleaning member is defined to be equal to or less than a particle diameter of toner, so that the cleaning performance on the transfer conveyor belt by the dielectric layer can be maintained higher than a predetermined level, thus effectively cleaning the transfer conveyor belt.

Since the toner moved to the surface of a cleaning member does not possibly enter into pits on the surface of the dielectric layer, the cleaning member can easily be cleaned. Thus, the cleaning member can clean the transfer conveyor belt in a state where the cleaning member itself is kept clean.

According to this invention, a dielectric layer made with a nylon-base material with its dielectric constant of 11 is provided and the dielectric layer is defined to 1000 $\mu$m or less, so that the amount of charge enabling deposition on the surface can sufficiently be stored, and the cleaning performance on the transfer conveyor belt based on the dielectric layer can be maintained higher than a predetermined level, thus effectively cleaning the transfer conveyor belt.

According to this invention, when a dielectric layer is provided on a roller-shaped member as a cleaning member, adhesion between the roller-shaped member and the dielectric layer can be promoted without using an adhesive, and imperfect cleaning of the transfer conveyor belt due to insufficient adhesion between the two can be prevented.

According to the invention in particular, the tapered extending sections are provided on the dielectric tube, so that the possibility that dielectric tube slips decreases more reliably and occurrence of the slip can be suppressed. Further, the transfer conveyor belt is not possibly rubbed with the edges of the extending sections, thus preventing the transfer conveyor belt from its being damaged.

According to this invention, the cleaning effect of a bias electric field can also be obtained by the bias application unit in a state where the cleaning effect of the dielectric layer is excellently maintained, thus more sufficiently cleaning the surface of the transfer conveyor belt.

Especially, by applying this invention to the transfer device, the cleaning effect of the bias electric field can more effectively be obtained because the surface of the dielectric layer is comparatively smooth. This is because the density of the line of electric force in the bias electric field near the surface of the dielectric layer becomes comparatively denser.

Further, by applying this invention to the transfer device in particular, an air layer is not possibly formed between the dielectric tube and the roller-shaped member, therefore, electric nonuniformity on the cleaning member does not occur. Thus, imperfect cleaning of a transfer conveyor belt due to electric nonuniformity on the cleaning member can be prevented.

Further, by applying this invention to the transfer device in particular, the roller-shaped member and the transfer conveyor belt do not directly contact each other. Thus, a leak of a cleaning bias due to a contact between the roller-shaped member and the transfer conveyor belt can be prevented.

According to this invention, by using the transfer device, an excellent image can be formed without occurrence of soil on the back of a transfer material due to imperfect cleaning of a transfer conveyor belt, or of defective transfer.

The present document incorporates by reference the entire contents of Japanese priority documents, 11-345064 filed in Japan on Dec. 3, 1999, 11-345069 filed in Japan on Dec. 3, 1999 and 2000-063915 filed in Japan on Mar. 8, 2000.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A transfer device comprising:

a transfer belt supported by a plurality of rotors, and configured to convey a transfer material, said transfer device transferring a toner image formed on an image carrier onto the transfer material on the transfer belt;

a cleaning member having a dielectric surface layer and configured to clean a surface of said transfer belt; and a bias application unit configured to apply to said cleaning member a cleaning bias having an opposite polarity to an electric charge polarity of a toner forming the toner image, wherein a volume resistivity of said dielectric surface layer is set to 1E3 ohm-cm or more, and wherein a surface resistivity of said dielectric surface layer is set to 1E4 ohms/square or more.

2. The transfer device according to claim 1, wherein the volume resistivity of said dielectric surface layer is set to 1E15 ohm-cm or less.

3. The transfer device according to claim 1, wherein the electric charge polarity of said toner is negative, and wherein a magnitude of the cleaning bias applied to said cleaning member is in a range from 300 to 2500 volts.

4. A transfer device comprising:

a transfer belt supported by a plurality of rotors, and configured to convey a transfer material, said transfer device transferring a toner image formed on an image carrier onto the transfer material on the transfer belt;

a cleaning member having a dielectric surface layer and configured to clean a surface of said transfer belt; and a bias application unit configured to apply to said cleaning member a cleaning bias having an opposite polarity to an electric charge polarity of a toner forming the toner image, wherein a surface resistivity of said dielectric surface layer is set to 1E4 ohms/square or more.

5. A transfer device comprising:

a transfer belt supported by a plurality of rotors, and configured to convey a transfer material, said transfer device transferring a toner image formed on an image carrier onto the transfer material on the transfer belt; and a cleaning member having a dielectric surface layer and configured to clean a surface of said transfer belt, wherein a dielectric constant of said dielectric surface layer is set to 3 or more.

6. The transfer device according to claim 5 further comprising:

a bias application unit configured to apply to said cleaning member a cleaning bias having an opposite polarity to an electric charge polarity of toner forming the toner image.

7. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer belt supported by a plurality of rotors, and configured to convey the transfer material;

a cleaning member having a dielectric surface layer and configured to clean a surface of said transfer belt; and a bias application unit configured to apply to said cleaning member a cleaning bias having an opposite polarity to an electric charge polarity of a toner forming the toner image, wherein a volume resistivity of said dielectric surface layer is set to 1E3 ohm-cm or more, and wherein a surface resistivity of said dielectric surface layer is set to 1E4 ohms/square or more.

8. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer belt supported by a plurality of rotors, and configured to convey the transfer material;

a cleaning member having a dielectric surface layer and configured to clean a surface of said transfer belt; and a bias application unit configured to apply to said cleaning member a cleaning bias having an opposite polarity to an electric charge polarity of a toner forming the toner image, wherein a surface resistivity of said dielectric surface layer is set to 1E4 ohms/square or more.

9. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer belt supported by a plurality of rotors, and configured to convey the transfer material; and a cleaning member having a dielectric surface layer and configured to clean a surface of said transfer belt, wherein a dielectric constant of said dielectric surface layer is set to 3 or more.

10. A transfer device comprising:

a transfer belt supported by a plurality of rotors, and configured to convey a transfer material, said transfer device transferring a toner image formed on an image carrier onto the transfer material on the transfer belt; and a cleaning member having a dielectric surface layer and configured to clean a surface of said transfer belt, wherein an electrostatic capacitance of said dielectric surface layer is set to 100 pF or more.

11. The transfer device according to claim 10 further comprising:

a bias application unit configured to apply to the cleaning member a cleaning bias having an opposite polarity to an electric charge polarity of a toner forming the toner image to said cleaning member.

12. The transfer device according to claim 11, wherein an electric charge polarity of said toner is negative, and wherein a magnitude of the cleaning bias applied to said cleaning member is in a range from 300 to 2500 volts.

13. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer belt supported by a plurality of rotors, and configured to convey the transfer material; and a cleaning member having a dielectric surface layer and configured to clean a surface of said transfer belt, wherein an electrostatic capacitance of said dielectric surface layer is set to 100 pF or more.

14. A transfer device comprising:

a transfer conveyor belt configured to convey a transfer material, said transfer device transferring a toner image formed on an image carrier onto the transfer material on the transfer belt; and a cleaning member contacting said transfer conveyor belt and configured to clean a surface of said belt, wherein the cleaning member comprises a dielectric surface layer made with a nylon-base material having a dielectric constant of 11, and a layer thickness of said dielectric surface layer is 1000 $\mu$m or less.

15. A transfer device comprising:

a transfer conveyor belt configured to convey a transfer material, said transfer device transferring a toner image formed on an image carrier onto the transfer material on the transfer belt; and a cleaning member contacting said transfer conveyor belt and configured to clean a surface of said belt, wherein said cleaning member comprises a dielectric tube having a dielectric surface layer and a roller-shaped member press-fitted into a hollow section of said tube, and wherein a surface resistivity of said dielectric surface layer is set to 1E4 ohms/square or more.

16. The transfer device according to claim 15, wherein said dielectric tube has outwardly extending sections at both ends of said roller-shaped member, and a shape of said extending sections is a tapered shape that a diameter of the extending sections is getting smaller as approaching the both ends of said dielectric tube in its width direction.

17. A transfer device comprising:

a transfer conveyor belt configured to convey a transfer material, said transfer device transferring a toner image formed on an image carrier onto the transfer material on the transfer belt;

a cleaning member contacting said transfer conveyor belt and configured to clean a surface of said belt; and a bias application unit configured to apply to the cleaning member a cleaning bias having an opposite polarity to an electric charge polarity of a toner for forming the toner image, wherein the cleaning member comprises a dielectric surface layer made with a nylon-base material having a dielectric constant of 11, and a layer thickness of said dielectric surface layer is 1000 $\mu$m or less.

18. A transfer device comprising:

a transfer conveyor belt configured to convey a transfer material, said transfer device transferring a toner image formed on an image carrier onto the transfer material on the transfer belt;

a cleaning member contacting said transfer conveyor belt and configured to clean a surface of said belt; and wherein said cleaning member comprises a dielectric tube having a dielectric surface layer and a roller-shaped member press-fitted into a hollow section of said tube, and wherein a surface resistivity of said dielectric surface layer is set to 1E4 ohms/square or more.

19. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer conveyor belt configured to convey the transfer material, said transfer device transferring a toner image formed on an image carrier onto the transfer material on the transfer belt; and a cleaning member contacting said transfer conveyor belt and configured to clean a surface of said belt, wherein the cleaning member comprises a dielectric surface layer made with a nylon-base material having a dielectric constant of 11, and a layer thickness of said dielectric surface layer is 1000 $\mu$m or less.

20. An image formation apparatus comprising:

an image carrier;

a toner image formation unit configured to form a toner image on said image carrier; and a transfer device configured to transfer the toner image formed on said image carrier onto a transfer material, said transfer device comprising:

a transfer conveyor belt configured to convey the transfer material, said transfer device transferring a toner image formed on an image carrier onto the transfer material on the transfer belt; and a cleaning member contacting said transfer conveyor belt and configured to clean a surface of said belt, wherein said cleaning member comprises a dielectric tube having a dielectric surface layer and a roller-shaped member press-fitted into a hollow section of said tube, and wherein a surface resistivity of said dielectric surface layer is set to 1E4 ohms/square or more.

* * * * *